US006557560B2

(12) United States Patent
Kastner

(10) Patent No.: US 6,557,560 B2
(45) Date of Patent: May 6, 2003

(54) CIGARETTE MAKING MACHINE

(75) Inventor: Arnold Kastner, Montreal (CA)

(73) Assignee: CTC Canada Inc., Montreal (CA)

( * ) Notice: Subject to any disclaimer, the term of this patent is extended or adjusted under 35 U.S.C. 154(b) by 0 days.

(21) Appl. No.: 09/882,332

(22) Filed: Jun. 18, 2001

(65) Prior Publication Data

US 2002/0189623 A1 Dec. 19, 2002

(51) Int. Cl.[7] ..... A24C 5/00
(52) U.S. Cl. ..... 131/73; 131/70; 131/280
(58) Field of Search ..... 131/70, 73, 280, 131/58

(56) References Cited

U.S. PATENT DOCUMENTS 2,731,971 A 1/1956 Kastner
3,127,900 A 4/1964 Kastner
4,411,278 A 10/1983 Kastner

*Primary Examiner*—Steven P. Griffin
*Assistant Examiner*—Dionne A. Walls
(74) *Attorney, Agent, or Firm*—Ogilvy Renault Guy Houle

(57) ABSTRACT

A cigarette making machine of the type wherein a portion of tobacco for one cigarette is compressed into a generally cylindrical form within a compressed tobacco chamber. The tobacco is thereafter axially moved and injected by an elongated spoon member into a preformed cigarette tube. A moveable wall member is actuated by a handle exteriorly of the machine through at least two toggle joints linking the moveable wall member to framing of the machine whereby to displace the moveable wall to transfer the tobacco in the tube. A first link of each toggle joint is in pivotal connection with the moveable wall member. A second link of each toggle joint is in pivotal connection with the framing of the machine. Each first link has a substantially rounded head portion at the free end thereof in operative contact with an abutment surface of the moveable wall member, for strengthening the pivotal connection therebetween.

3 Claims, 2 Drawing Sheets

CIGARETTE MAKING MACHINE

FIELD OF THE INVENTION

The present invention relates to a cigarette making machine for domestic use and, more particularly, to improvements thereto.

BACKGROUND OF THE INVENTION

U.S. Pat. No. 2,731,971, issued on Jan. 24, 1956 to Karl Kastner, discloses a cigarette making machine for domestic use which compresses a portion of tobacco equivalent to one cigarette and then injects the tobacco in a pre-formed cigarette tube by means of a plunger. The pre-formed empty cigarette tube is held at one end of a hollow nipple of the cigarette making machine during the injection of the portion of tobacco. Once the compressed tobacco is fully injected into the pre-formed cigarette tube, it is released from the cigarette making machine to be smoked or stored for later smoking thereof.

U.S. Pat. No. 3,127,900, issued on Apr. 7, 1964, and U.S. Pat. No. 4,411,278, published on Oct. 25, 1983, each by the present inventor, provide various improvements to the cigarette making machine described in U.S. Pat. No. 2,731,971. For instance, U.S. Pat. No. 3,127,900 discloses modifications to the above described cigarette making machine to adapt it for making cigarettes with pre-formed cigarette tubes having a filter at an end. U.S. Pat. No. 4,411,278, discloses a cigarette making machine of the same general type as discussed above, but by providing a new manufacturing method for substantially reducing the cost of production of the prior art devices.

With the advent of "expanded cut tobacco", developed by the tobacco industry over the years, the users of the above described cigarette making machines have encountered problems therewith. The expanded cut tobacco is characterized by smaller grains of expanded tobacco compared to the longer strands that were used by all tobacco manufacturers. The expanded cut tobacco increases the volume of tobacco by more than 100%. With the expanded cut tobacco, the above disclosed cigarette making machines must sustain greater operating pressures when compressing tobacco, whereby the mechanism within the cigarette making machines gets worn and has a tendency to fishtail, as will be explained hereinbelow. The fishtailing causes uneven compression of the tobacco by the compressing chamber of the cigarette making machine, and thereby causes the tobacco to be unevenly distributed in the cigarette.

SUMMARY OF THE INVENTION

Therefore, it is a feature of the present invention to provide a cigarette making machine substantially which overcomes the above-mentioned disadvantages of the prior art.

According to the above features, from a broad aspect, the present invention provides a cigarette making machine of the type wherein a portion of tobacco for one cigarette is compressed into a generally cylindrical form within a compressed tobacco chamber. The tobacco is thereafter axially moved and injected by an elongated spoon member into a preformed cigarette tube disposed on a hollow nipple exteriorly of the machine. The compressed tobacco chamber has a portion thereof defined by a moveable wall member. The moveable wall member is actuated by a handle exteriorly of the machine through at least two toggle joints linking the moveable wall member to framing of the machine. The moveable wall member is displaceable between a retracted position and a tobacco compacting position. Each toggle joint has a first and a second link pivotally interconnected at a joint. The first link of each toggle joints is in pivotal connection with the moveable wall member. The second link of each toggle joints is in pivotal connection with the framing of the machine. Each first link has a substantially rounded head portion at the free end thereof. The rounded head portions are in operative contact with an abutment surface of the moveable wall member, for strengthening the pivotal connection therebetween.

BRIEF DESCRIPTION OF THE DRAWINGS

A preferred embodiment of the present invention will now be described in detail having reference to the accompanying drawings in which.

DESCRIPTION OF THE PREFERRED EMBODIMENT

Figure 1:
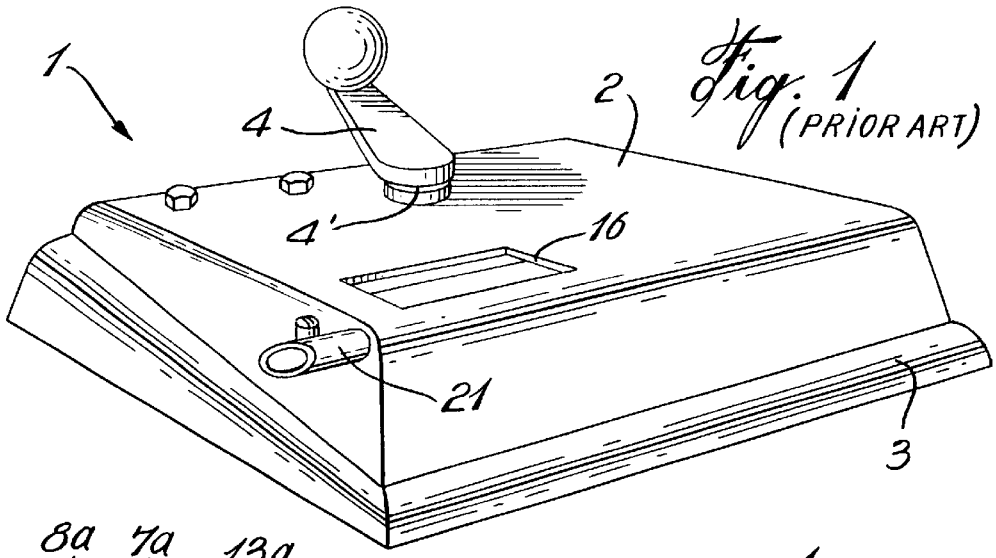
Fig. 1 (PRIOR ART)
FIG. 1 is a perspective view of a cigarette making machine of the prior art.
Figure 2:
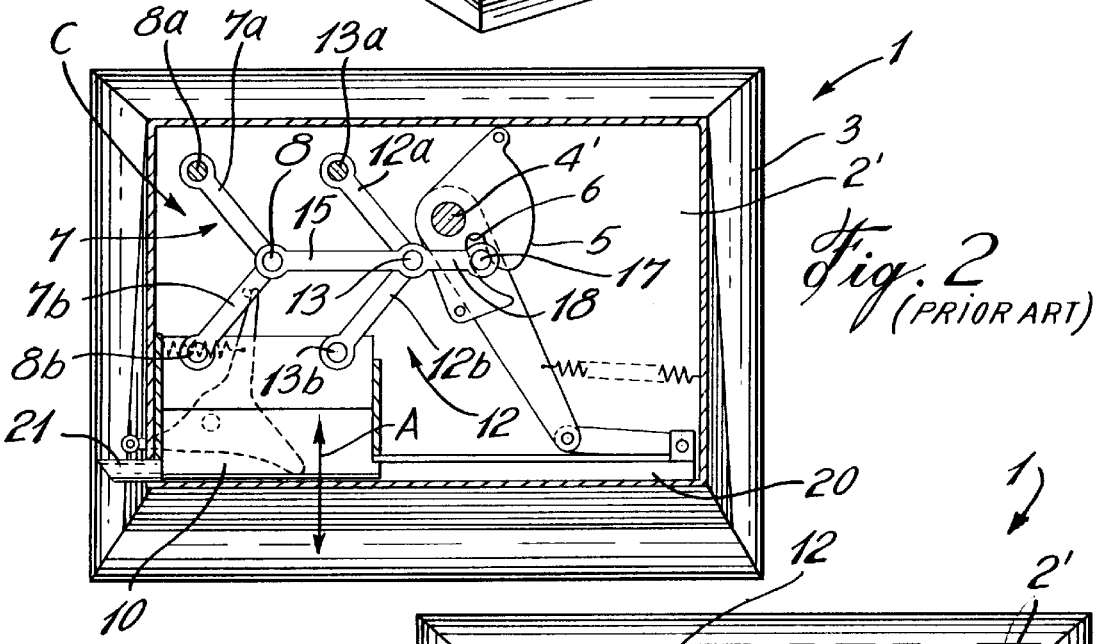
Fig. 2 (PRIOR ART)
FIG. 2 is a top plan view, partly sectioned, of the cigarette making machine of FIG. 1 of the prior art in a retracted position.
Figure 3:
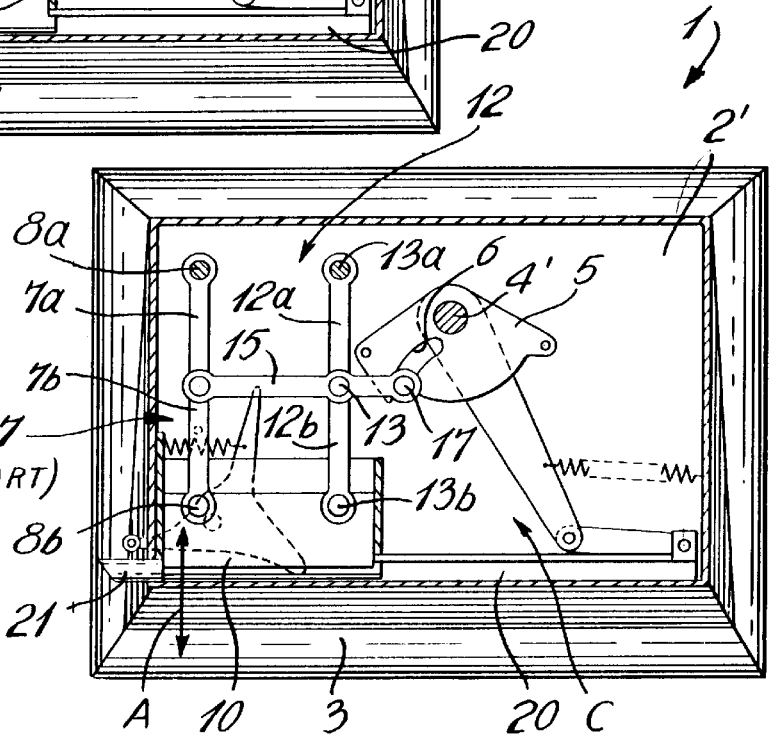
Fig. 3 (PRIOR ART)
FIG. 3 is a top plan view, partly sectioned, of the cigarette making machine of FIG. 1 of the prior art in a compacting position.

For convenience purposes, the operation of a cigarette making machine in accordance with the prior art is illustrated in FIGS. 1, 2 and 3 and is given hereinbelow a brief description.

As illustrated in FIG. 1, the cigarette making machine is generally shown at 1 and is defined by an upper portion 2 and a base 3. Referring now to both FIGS. 1 and 2, a compressing mechanism C of the cigarette making machine 1 is secured to an underside 2' of the upper portion 2, and is operated by rotating a handle 4 pivotally disposed on upper portion 2 at a pivot 4'. The compressing mechanism C has a cam member 5 secured to an opposed end of the pivot 4' at the underside 2', such as to rotate therewith. The cam member 5 defines an arcuate slot 6.

The compressing mechanism C comprises a compacting member 10 which translates according to arrow A between a retracted position, as shown in FIG. 2, and a compacting position, as shown in FIG. 3. The translation of the compacting member 10 is actuated by the handle 4 through the compressing mechanism, as will be explained herein below.

The compressing mechanism C has first and second toggle joints 7 and 12, respectively. The first toggle joint 7 is comprised of links 7*a* and 7*b*, which are pivotally interconnected at pivot 8. The link 7*a* is anchored to the underside 2' of the machine 1 at pivot 8*a* such as to pivot thereabout. The free end of link 7*b* is secured to a pivot 8*b* which is on a compacting member 10 of the cigarette making machine 1.

Similarly, the second toggle joint 12 is comprised of links 12*a* and 12*b*, pivotally interconnected at pivot 13. The link 12*a* is secured at a free end thereof to pivot 13*a* and is enabled to pivot thereabout. The link 12*b* is operatingly connected to pivot 13*b*, which is also disposed on the compacting member 10. An arm 15 interconnects the pivots 8 and 13 of the first and second toggle joints 7 and 12, respectively. The arm 15 has a pin 17 on an extension 18 thereof. The pin 17 is operatively engaged in the arcuate slot 6 of the cam member 5, such that a rotation of the handle 4 will displace the arm 15 and thus the compacting member 10 through the toggle joints 7 and 12.

Referring to FIGS. 2 and 3, the interconnection of the toggle joints 7 and 12 is illustrated. In FIG. 2, the toggle joints are depicted with the opposed links 7*a* and 7*b* and 12*a* and 12*b* being angulated with respect one to another. In this case, the compacting member 10 is in the retracted position. When the compacting member 10 is in the retracted position, tobacco may be disposed in a compacting chamber of the cigarette making machine 1 through an aperture 16 in the upper portion 2 thereof, as depicted in FIG. 1.

Referring now to FIG. 3, the opposed links 7*a* and 7*b* and 12*a* and 12*b* are colinear, and this position is the compacting position. In this case, the compacting member 10 compresses the previously filled tobacco in the compacting chamber. In a subsequent step which is however not shown, the compressed tobacco is pushed by a plunger 20 in a cigarette tube disposed on a hollow nipple 21 of the cigarette making machine 1.

As the other moving elements of the cigarette making machine 1 are not concerned by the present invention, a description of their use will not be provided.

It is understood that the use of a pair of toggle joints, i.e. toggle joints 7 and 12, is essential for ensuring that the compacting member 10 translates substantially parallel to itself while translating back and forth from the retracted position to the compacting position. It is also readily understood that such toggle joints are used for amplifying forces. In this case, the rotation of the handle 4 is converted in a compression of tobacco by the compacting member 10, through the toggle joints 7 and 12. Thus a high amount of stress is sustained by the pivots 8*a*, 8*b*, 13*a* and 13*b*.

Because of the use of the expanded cut tobacco as described hereinabove, a greater amount of torque must be supplied to the handle 4 in order to compress the tobacco with the compacting member 10. Accordingly, a greater amount of pressure is sustained by the pivots 8*a*, 8*b*, 13*a* and 13*b*. With time, the pivots have been known to be subject to deformation and premature wear due to the increased amount of stress they are submitted to. Consequently, the links 7*a*, 7*b*, 12*a* and 12*b* become loose in their linkage, whereby the arm 15 is said to fishtail. This results in the compacting member 10 having different values of pressure exerted thereon at pivots 13*a* and 13*b*, whereby the compacting member 10 no longer applies an even pressure on the tobacco throughout its length. This results in an imperfect cigarette with the tobacco density varying along the length of the cigarette, thus leaving the smoker unsatisfied.

Figure 4:
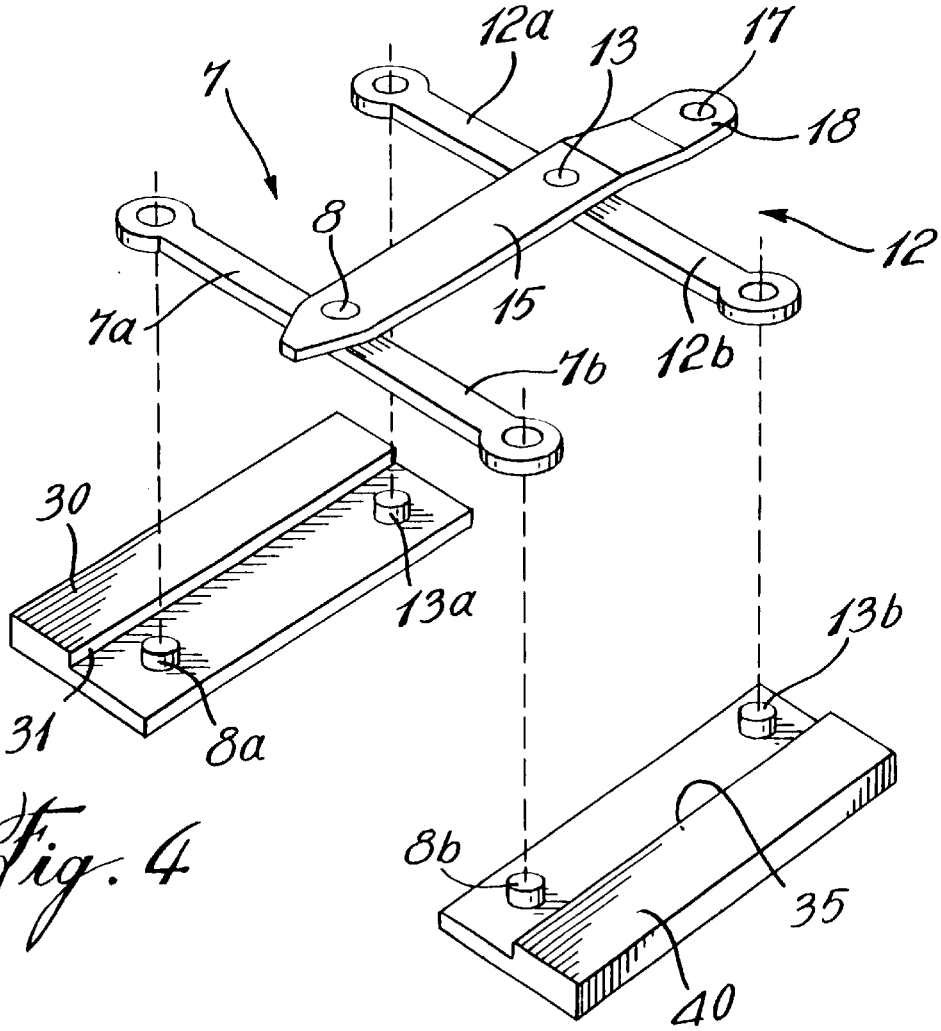
FIG. 4 is an exploded perspective view of toggle joints in accordance with the present invention.
Figure 5:
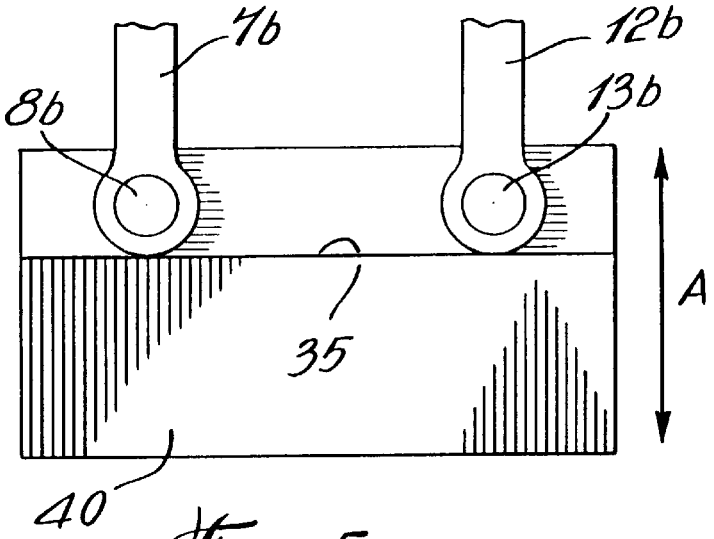
FIG. 5 is a fragmented top plan view of an abutment surface in accordance with the present invention.

It has thus been thought to provide abutment surfaces which will partly sustain a part of the load sustained by the pivots 8*a*, 8*b*, 13*a* and 13*b*. Referring to FIG. 4, the first and second toggle joints 7 and 12 are shown pivotally connected to the arm 15, as described in the prior art. The pivots 8*a* and 13*a* are now disposed on an abutment block 30 in accordance with the present invention and having an abutment edge surface 31. When the links 7*a* 12*a* are pivotally engaged on the pivots 8*a* and 13*a*, their free ends, each having a substantially circular surface, will be operatively abutting against the abutment edge surface 31 such as to constantly be in contact therewith. The abutment edge surface 31 will sustain a portion of the load submitted to the pivots 8*a* and 13*a*. Similarly, a compacting member 40 in accordance with the present invention has been provided with an abutment edge surface 35 to replace the compacting member 10 of the prior art. When the links 7*b* and 12*b* are pivotally engaged on the pivots 8*b* and 13*b*, the substantially circular free ends thereof will be abutting the abutment edge surface 35 such as to rotate thereon and constantly be in contact therewith. Consequently, when the compacting member 40 is in the compacting position, the abutment edge surfaces 31 of the abutment block 30 and 35 of the compacting member 40 will sustain a portion of the load previously completely sustained by the pivots 8*a*, 8*b*, 13*a* and 13*b*.

It is within the ambit of the present invention to cover any obvious modifications of the embodiments described herein, provided such modifications fall within the scope of the appended claims.

I claim:

1. A cigarette making machine of the type wherein a portion of tobacco for one cigarette is compressed into a generally cylindrical form within a compressed tobacco chamber, said tobacco being thereafter axially moved and injected by an elongated spoon member into a preformed cigarette tube disposed on a hollow nipple exteriorly of said machine, said compressed tobacco chamber having a portion thereof defined by a moveable wall member, said moveable wall member being actuated by a handle exteriorly of said machine through at least two toggle joints linking said moveable wall member to framing of said machine, said moveable wall member being displaceable between a retracted position and a tobacco compacting position;

wherein each said toggle joints has a first and a second link pivotally interconnected at a joint;

said first link of each said toggle joints being in pivotal connection with said moveable wall member;

said second link of each said toggle joints being in pivotal connection with said framing of said machine; and wherein each said first links has a substantially rounded head portion at said free end thereof, said rounded head portions being in operative contact with an abutment surface of said moveable wall member, for strengthening the pivotal connection therebetween, said second links having a substantially rounded head portion at said free end thereof, said rounded head portions being in operative contact with an abutment surface of said framing of said machine for strengthening the pivotal connection therebetween.

2. The cigarette making machine according to claim 1, wherein said abutment surface of said moveable wall member is substantially perpendicular to said links when said moveable wall member is in said tobacco compacting position.

3. The cigarette making machine according to claim 1, wherein said abutment surface of said framing of said machine is substantially perpendicular to said links when said moveable wall member is in said tobacco compacting position.

* * * * *